US005513474A

United States Patent [19]

Scharkowski

[11] Patent Number: 5,513,474

[45] Date of Patent: May 7, 1996

[54] DOUBLE-WALLED FORMWORK ELEMENT AND PROCESS FOR MANUFACTURING IT

[75] Inventor: Jurgen Scharkowski, Mogendorf, Germany

[73] Assignee: Steuler-Industriewerke GmbH, Hohr-Grenzhausen, Germany

[21] Appl. No.: 232,176

[22] PCT Filed: Oct. 29, 1992

[86] PCT No.: PCT/EP92/02474

§ 371 Date: May 20, 1994

§ 102(e) Date: May 20, 1994

[87] PCT Pub. No.: WO93/09042

PCT Pub. Date: May 13, 1993

[30] Foreign Application Priority Data

Oct. 29, 1991 [DE] Germany ..... 41 35 641.1

[51] Int. Cl.[6] ..... E04B 1/62; B65D 90/04

[52] U.S. Cl. ..... 52/309.17; 52/249; 52/333; 52/508; 52/511; 52/745.05; 220/469; 249/35; 249/44; 249/114.1

[58] Field of Search ..... 249/112, 114.1, 249/134, 192, 44, 47, 35, 11; 52/249, 267, 746, 745.05, 506.01, 506.02, 506.05, 508, 511, 309.17, 309.14, 333, 340; 220/465, 469, 565

[56] References Cited

U.S. PATENT DOCUMENTS

| | | | |
|---|---|---|---|
| 1,130,988 | 3/1915 | Lape | 220/465 X |
| 2,382,171 | 8/1945 | Pomykala | 220/565 X |
| 2,914,149 | 11/1959 | Walker | 220/565 X |
| 3,454,080 | 7/1969 | Künzli | 165/47 |
| 3,536,226 | 10/1970 | Tornay | 220/465 X |
| 3,712,012 | 1/1973 | Meyer et al. | 52/249 |
| 4,239,827 | 12/1980 | Notaro | 220/469 X |
| 4,355,453 | 10/1982 | Pause et al. | 52/746 X |
| 4,595,435 | 6/1986 | Rohringer | 52/309.17 X |
| 4,712,711 | 12/1987 | Geering et al. | 220/465 X |
| 5,000,342 | 3/1991 | Sharp | 220/469 X |
| 5,177,918 | 1/1993 | Chang | 52/333 X |
| 5,281,052 | 1/1994 | Beamer | 249/11 X |

FOREIGN PATENT DOCUMENTS

| | | | |
|---|---|---|---|
| 922428 | 3/1973 | Canada | 52/249 |
| 358164 | 3/1990 | European Pat. Off. . | |
| 1555558 | 12/1968 | France . | |
| 3235185 | 3/1984 | Germany | 220/565 |
| 3601262 | 7/1987 | Germany . | |
| 5272221 | 10/1993 | Japan | 52/506.01 |
| 658251 | 4/1979 | U.S.S.R. | 52/249 |
| 9220 | of 1891 | United Kingdom | 52/506.01 |

*Primary Examiner*—Carl D. Friedman
*Assistant Examiner*—Laura A. Saladino
*Attorney, Agent, or Firm*—Parmelee, Bollinger & Bramblett; George W. Rauchfuss, Jr.

[57] ABSTRACT

Proposed is a double-walled formwork element comprising two large-area panels suitable for use as mould shuttering, particularly in the concrete construction industry. The two panels are joined to each other by force-locking, liquid-tight and gas-tight engagement, and form between them a cavity. The invention secures the two layers of shuttering against slippage and ensures the discharge of any leak liquid produced. The invention also enables shuttering systems to be assembled cheaply and simply for constructions of various shapes.

16 Claims, 4 Drawing Sheets

DOUBLE-WALLED FORMWORK ELEMENT AND PROCESS FOR MANUFACTURING IT

Figure 1:
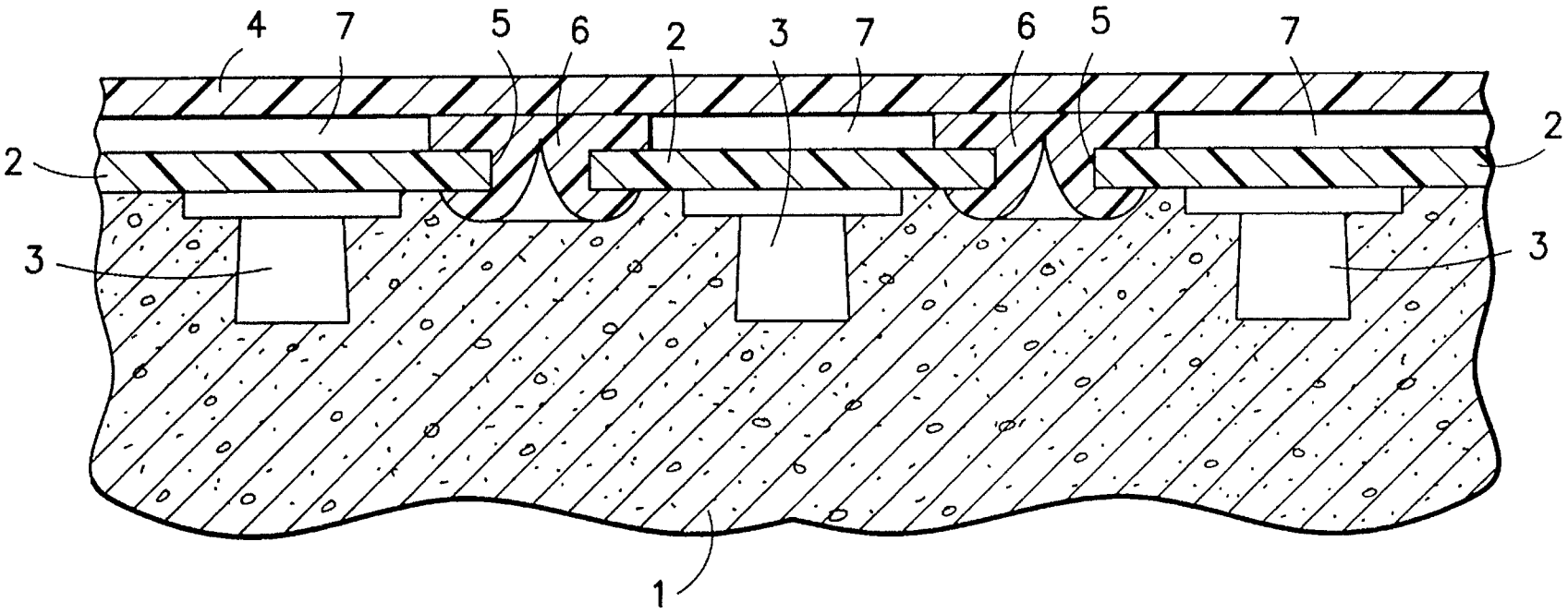

The present invention relates to a double-walled formwork or lining element comprising two large-area panels suitable for use as mould shuttering, particularly in the concrete construction industry, as well as to a process for manufacturing it.

Shutterings or linings are used as chemically resistant, liquid-tight and gas-tight protection for a variety of applications, e.g. for concrete containers, pipelines, channels etc.

The EP-A-0 059 929 discloses formwork elements which consist of a lining panel composed of thermoplastic material and which are attached to for instance the wall of concrete constructions by means of a plurality of anchoring knobs.

For a number of cases, the shuttering must have a double-walled structure; this applies particularly to containers, pipelines, channels etc. which are designed to contain or to convey highly water-polluting liquids or are subject to specific requirements for the purpose of preventing water and/or groundwater pollution. This means that for instance the container walls have to be protected by two liquid-tight and gas-tight layers of shuttering.

For this purpose, liquid-tight and gas-tight containers made of thermoplastic material are known which are for instance placed into a concrete container lined with the above described panels. This measure has the disadvantage that e.g. the interior liquid-receiving container is not in force-locking engagement with the concrete construction and/or the lining panel directly fixed on the concrete. Therefore, it cannot absorb any backward or lateral forces and is not secured against any shifts.

In contrast to this, it is an object of the present invention to provide a large-area formwork element suitable for use as mould shuttering and comprising two substantially parallel panels forming a continuous cavity between them, as well as a process for manufacturing it, wherein the two lining panels are joined to each other by force-locking, liquid-tight and gas-tight engagement.

This object is achieved with the features of the claims.

The solution of the invention is based on the following ideas:

A first lining panel manufactured according to conventional methods which is provided with anchoring knobs welded onto it is connected to a second lining panel by means of a plurality of connecting knobs. The connecting knobs are affixed to the second lining panel, they are inserted into bores of the first lining panel and welded to it to produce a liquid-tight and gas-tight joint. In this connection, the exposed part of the connecting knobs between the two lining panels determines the distance of the panels to each other. In the case of e.g. a container, the first lining panel is secured to e.g. a concrete wall by means of the anchoring knobs in such a way that it lies on the concrete wall while the second lining panel is in contact with e.g. a liquid.

The advantages of the present invention are that it allows the two lining panels to be firmly joined to each other and secured against shifts or slippage; any leak liquid produced may run off between the two panels. In addition, the formwork element according to the present invention also enables shuttering systems to be assembled cheaply and simply for constructions of various shapes; furthermore, the joint between the lining panels is form-locking.

It is preferred that the individual parts of the formwork element, such as the two lining panels, the anchoring knobs and the connecting knobs, are made of plastics, thermoplastic materials being particularly preferred. It is possible to either produce the individual parts from the same material or from different materials.

Figure 2:
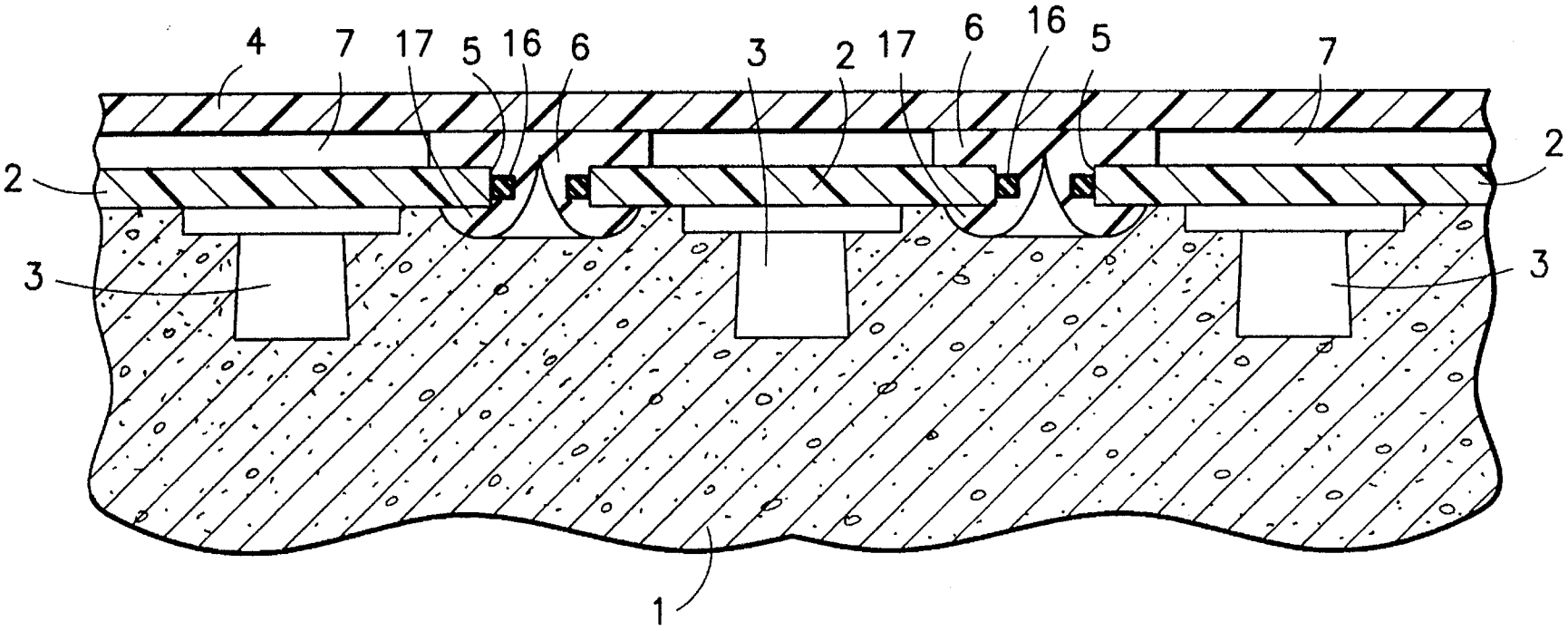
Figure 3:
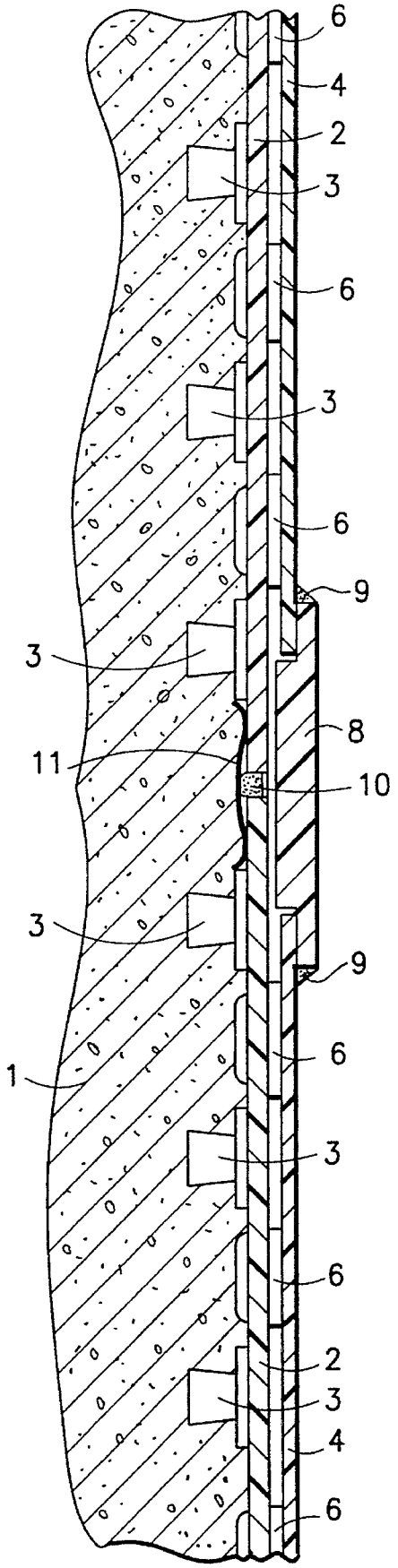
Figure 4:
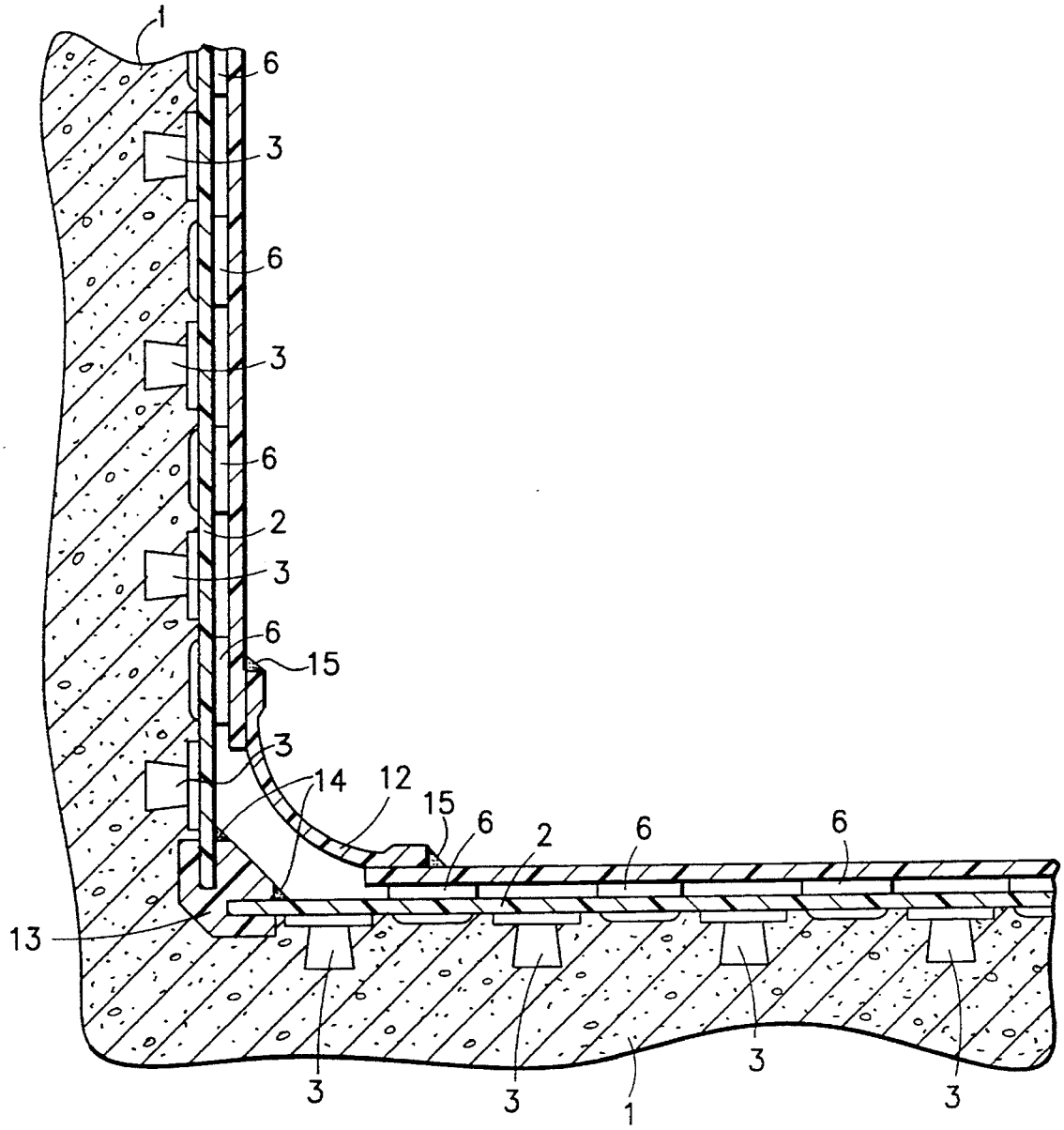

In the following, the invention is described in more detail with reference to the accompanying drawings wherein FIG. 1 shows a partial cross-sectional view of an embodiment of the present invention attached to a concrete wall, FIG. 2 shows a partial cross-sectional view of another variant of the embodiment of the present invention illustrated in FIG. 1, FIG. 3 shows a partial cross-sectional view of a shuttering system according to the present invention in the region of a lateral joint between two formwork elements, and FIG. 4 shows a partial cross-sectional view of a shuttering system according to the present invention in the region of an edge joint between two formwork elements.

According to FIGS. 1 to 4, the formwork element consists of a first and a second lining panel 2 and 4, respectively, which are joined to each other by a plurality of connecting knobs 6 and form between them a continuous cavity 7. The first or outer lining panel 2 comprises a plurality of anchoring knobs 3 on the side faced away from the second or inner lining panel 4, which anchoring knobs 3 allow the formwork element to-be secured to e.g. the wall of a concrete construction (container, channel, pipeline etc.) in such a way that it lies on said wall. The second or inner lining panel 4 is in contact with the contents of the concrete construction, for instance a water-polluting liquid.

FIG. 1 exemplifies the connection of the second lining panel 4 to the first lining panel 2 which is secured in the concrete 1 by means of the anchoring knobs 3.

The connecting knobs 6 which are secured to the lining panel 4 (e.g. by welding or integrally) pass through the bores 5 in the lining panel 2 and are welded to the back surface of the lining panel 2. The connecting knobs 6 have a larger cross section than the bores 5 in their outer part which is faced towards the second lining panel 4 and adjacent to the first lining panel 2. Due to this, they rest on the lining panel 2 and form a defined distance, namely the cavity 7, to the panel 4. The joint between the connecting knobs 6 and the first lining panel 2 is liquid-tight and gas-tight, thus preventing liquid or gas from entering behind the lining panel 2. Any leak liquid produced by leakages in the second lining panel 4 runs into the continuous cavity 7 and can be discharged. The connecting knobs 6 ensure a force-locking engagement between the first and the second lining panels 2 and 4, respectively; this allows backward forces to be absorbed and reliably prevents the lining panel 4 from shifting relative to the concrete construction.

Other embodiments are possible instead of the connection between the connecting knobs 6 and the lining panel 2 which is shown in FIG. 1. The connecting knobs 6 may for instance be welded to the first lining panel 2 in its plane and not to its back surface.

In a further embodiment, the connecting knobs 6 may be connected to the first lining panel 2 by fitting them into it by means of a hot-press process.

The formwork element according to the present invention is preferably made of thermoplastic material.

In FIG. 2, the connecting knobs 6 are riveted to the back surface of the lining panel 2. The liquid-tight and gas-tight seal is achieved by acid-proof and/or alkali-proof O-rings 16 which are arranged on the shafts 17 of the connecting knobs, adjacent to the walls of the bores 5, and which are clamped between the connecting knobs 6 and the walls of the bores 5 due to the expansion of the shafts 17 occurring during the riveting. During the assembly of the formwork element, the O-ring 16 can be held in place by conically widening the shaft 17, by means of a groove or by a force fit. The embodiment of the present invention shown in FIG. 2 also allows the combined use of different thermoplastics, for instance polyethylene (PE) and polyvinylidene fluoride (PVDF).

It is advantageous that several formwork elements according to the present invention can be combined to form a shuttering system, as shown in FIGS. 3 and 4.

FIG. 3 shows the connection of two lining panels to the side wall of e.g. a concrete construction 1. The first lining panels 2 are joined to each other at a ledge 11 by the weld 10 and sealed against the concrete wall. On the inward side of the formwork elements, the second lining panels 4 are welded with a cover ledge 8 at the welds 9 and are sealed against e.g. a liquid.

FIG. 4 shows an edge joint according to the present invention in a shuttering system according to the present invention. The first lining panels 2 are connected with each other by an edge joint ledge 13 (for instance at an angle of 90°) that is welded with the lining panels at the welds 14. The second lining panels 4 are joined to each other by a quarter circle connecting piece 12 which is welded with the insides of the lining panels at the welds 15.

Within the scope of the present invention, edge joint ledges 13 having an angle greater or less than 90° and connecting pieces of different shape are also possible, according to the various concrete constructions (containers, channels etc.).

In addition, the formwork elements according to the present invention with the cavity 7 formed between them may provide a leak detecting system; this makes the transport or storage of hazardous liquids considerably safer.

I claim:

1. A double-walled formwork element of thermoplastic material for covering concrete walls, comprising:

a) a first lining panel (2) with a plurality of anchoring knobs (3) for anchoring in the wall (1), and b) a second lining panel (4), wherein c) the first and the second lining panel (2 and 4, respectively) are joined to each other by a plurality of connecting knobs (6) on the side which is faced away from the wall (1) by force-locking, liquid-tight and gas-tight engagement, d) the plurality of connecting knobs (6) simultaneously serve as spacers between the first and the second lining panel (2 and 4, respectively), thus forming a cavity (7) between the first a the second lining panel, and e) wherein the connecting knobs (6) are inserted into bores (5) of the first lining panel (2).

2. The formwork element according to claim 1, wherein the connecting knobs (6) have a larger cross section than the bores (5) in their outer part faced towards the second lining panel (4) and adjacent to the first lining panel (2).

3. The formwork element according to claim 2, consisting of one or more thermoplastic materials.

4. The formwork element according to claim 2, wherein the connecting knobs (6) pass through the bores (5) and are welded to the back surface of the first lining panel (2).

5. The formwork element according to claim 2, wherein the connecting knobs (6) are connected to the first lining panel (2) by means of hot press fitting.

6. The formwork element according to claim 2, wherein the connecting knobs (6) are riveted with the first lining panel (2) and are sealed against the walls of the bores (5) by means of acid-proof or alkali-proof O-rings (16).

7. A shuttering system consisting of a plurality of double-walled formwork elements according to claim 2 which are successively joined to each other by force-locking, liquid-tight and gas-tight engagement.

8. The formwork element according to claim 1, wherein the connecting knobs (6) pass through the bores (5) and are welded to the back surface of the first lining panel (2).

9. The formwork element according to claim 1, wherein the connecting knobs (6) are connected to the first lining panel (2) by means of hot press fitting.

10. The formwork element according to claim 1, wherein the connecting knobs (6) are riveted with the first lining panel (2) and are sealed against the walls of the bores (5) by means of acid-proof or alkali-proof O-rings (16).

11. A process for manufacturing a double-walled formwork element according to claim 1, comprising the steps of:

a) providing the first lining panel (2) having the plurality of anchoring knobs (3) for anchoring in a concrete construction (1), b) providing the second lining panel (4), and c) joining the first and the second lining panel (2 and 4, respectively) by force-locking, liquid-tight and gas-tight engagement by means of the plurality of connecting knobs (6) on the side which is faced away from the concrete construction (1) and wherein the connecting knobs (6) are inserted into the bores (5) of the first lining panel (2), the plurality of connecting knobs (6) simultaneously serving as spacers between the first and the second lining panel (2 and 4, respectively), thus forming the cavity (7) between the first and the second lining panel.

12. The process according to claim 11, wherein step c) comprises:

$c_1$) inserting the connecting knobs (6) into the bores (5) in such a way that the ends of the connecting knobs (6) project beyond the back surface of the first lining panel (2), and $c_2$) welding the connecting knobs (6) with the first lining panel (2) on its back surface.

13. The process according to claim 11, characterized in that step c) comprises the fitting of the connecting knobs (6) into the first lining panel (2) by means of hot-pressing.

14. The process according to claim 11, wherein step c) comprises:

$c_1$) inserting the connecting knobs (6) with acid-proof or alkali-proof O-rings (16) arranged on it into the bores (5) in such a way that the ends of the knobs (6) project beyond the back surface of the first lining panel (2) and the O-rings (16) face the walls of the bores (5); and $c_2$) riveting the connecting knobs (6) with the back surface of the first lining panel (2), the O-rings (16) being clamped between the connecting knobs (6) and the walls of the bores (5) in a sealing manner.

15. A shuttering system, consisting of a plurality of double-walled formwork elements according to claim 1 which are successively joined to each other by force-locking, liquid-tight and gas-tight engagement.

16. A process for manufacturing a shuttering system according to claim 15, characterized in that the plurality of double-walled formworks are successively joined to each other by force-locking, liquid-tight and gas-tight engagement.

* * * * *